US006193771B1

(12) United States Patent
Patrello

(10) Patent No.: US 6,193,771 B1
(45) Date of Patent: Feb. 27, 2001

(54) METHOD FOR MAKING DEPRESSED CENTER ABRASIVE WHEELS

(75) Inventor: Joseph Patrello, Glastonbury, CT (US)

(73) Assignee: United Abrasives, Willimantic, CT (US)

( * ) Notice: Subject to any disclaimer, the term of this patent is extended or adjusted under 35 U.S.C. 154(b) by 412 days.

(21) Appl. No.: 08/680,602

(22) Filed: Jul. 16, 1996

(51) Int. Cl.[7] ..... B24D 11/00

(52) U.S. Cl. ..... 51/297; 51/298; 264/119; 264/120

(58) Field of Search ..... 264/119, 120; 51/298, 297

(56) References Cited

U.S. PATENT DOCUMENTS 2,656,654 * 10/1953 Erickson ..... 51/297
2,745,224 * 5/1956 Erickson ..... 51/298
3,836,345 * 9/1974 Graham ..... 51/298
4,615,151 * 10/1986 Huber ..... 51/298

* cited by examiner

*Primary Examiner*—James Derrington
(74) *Attorney, Agent, or Firm*—McCormick, Paulding & Huber LLP

(57) ABSTRACT

Relatively thin type 27 depressed center abrasive wheels are made from initially flat "green" wheels made in a hydraulic press that has flat upper and lower surfaces in each press cavity. These thin flat wheels are clamped in a fixture that forms the center portions as the wheels are clamped to provide "green" wheels that are not only thin, but that have depressed center portions of undistorted internal geometry. The "green" wheels are then cured in this clamped condition in a furnace at appropriate temperatures that achieve the necessary hardening of the resinous mixture to yield thin depressed center abrasive cutting wheels.

4 Claims, 3 Drawing Sheets

METHOD FOR MAKING DEPRESSED CENTER ABRASIVE WHEELS

BACKGROUND OF THE INVENTION (1) Field of the Invention

The present invention relates to an improved method of manufacturing depressed center abrasive wheels having a thickness of less than three thirty seconds (3/32) of an inch. Such wheels are called type 27 cut off wheels.

(2) Description of Prior Art

Depressed center type 27 cutting wheels are currently manufactured by a process that provides for layers of grit or grain in a resin mixture with fiberglass reinforcement mats provided in a cavity having the general profile of the final depressed center shape of the wheel. After such lay-up is prepared in the cavity, the lay-up is compressed so that the center and outer portions of the wheel must be successively formed to provide a depressed center wheel in the "green" state.

A stack of like wheels are then provided between metal plates for transfer to an oven to cure the "green" wheels.

Depressed center resin-type cutting wheels of this general character have been restricted in thickness because this pressing operation of forming a depressed center wheel in the "green" state, causes the resin mixtures and the fiberglass to be pulled toward the center of the wheel, causing the wheel to lose total uniformity or homogeneity throughout the lay-up. This problem has resulted in the thickness of such type 27 depressed center cutting wheels being limited to more than three thirty-seconds of an inch in thickness. Depressed center wheels of less than 3/32 of an inch are adversely affected by this conventional process of making such wheels. The present invention relates to fulfilling the need for type 27 depressed center resin-type wheels of less than 3/32 of an inch in thickness.

SUMMARY OF THE INVENTION

It is a general purpose and object of the present invention to provide an improved method for fabricating type 27 depressed center abrasive cutting wheels having a thickness of less than 3/32 of an inch. The process to be described provides a type 27 depressed center cutting wheel that does not suffer from the disadvantage of non-uniformity in its lay-up either in the "green" state or in the cured state of the final wheel.

This object is accomplished with the present invention by providing a generally flat wheel cavity in a press, and providing a lay-up of abrasive grains and resin together with suitable reinforcing mats in a flat wheel cavity of said press, followed by compressing such lay-up between parallel cavity surfaces to provide a relatively thin flat "green" wheel.

The relatively thin flat "green" wheel is then provided in a fixture which clamps the flat wheel between non-parallel plates, each plate having a depressed center portion, so that the thin, flat "green" wheel is "formed" into a wheel with a depressed center portion while in the "green state". The wheel is then subjected to the necessary heating for curing the resin, and a relatively thin abrasive wheel of less than 3/32 of an inch in thickness is provided with a depressed center portion. Such a wheel has the same desired uniformity throughout, such as now only available in thicker wheels of this type 27 depressed center geometry.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding references characters indicate corresponding parts throughout the several views of the drawings and wherein.

DESCRIPTION OF THE PREFERRED EMBODIMENT

Figure 1:
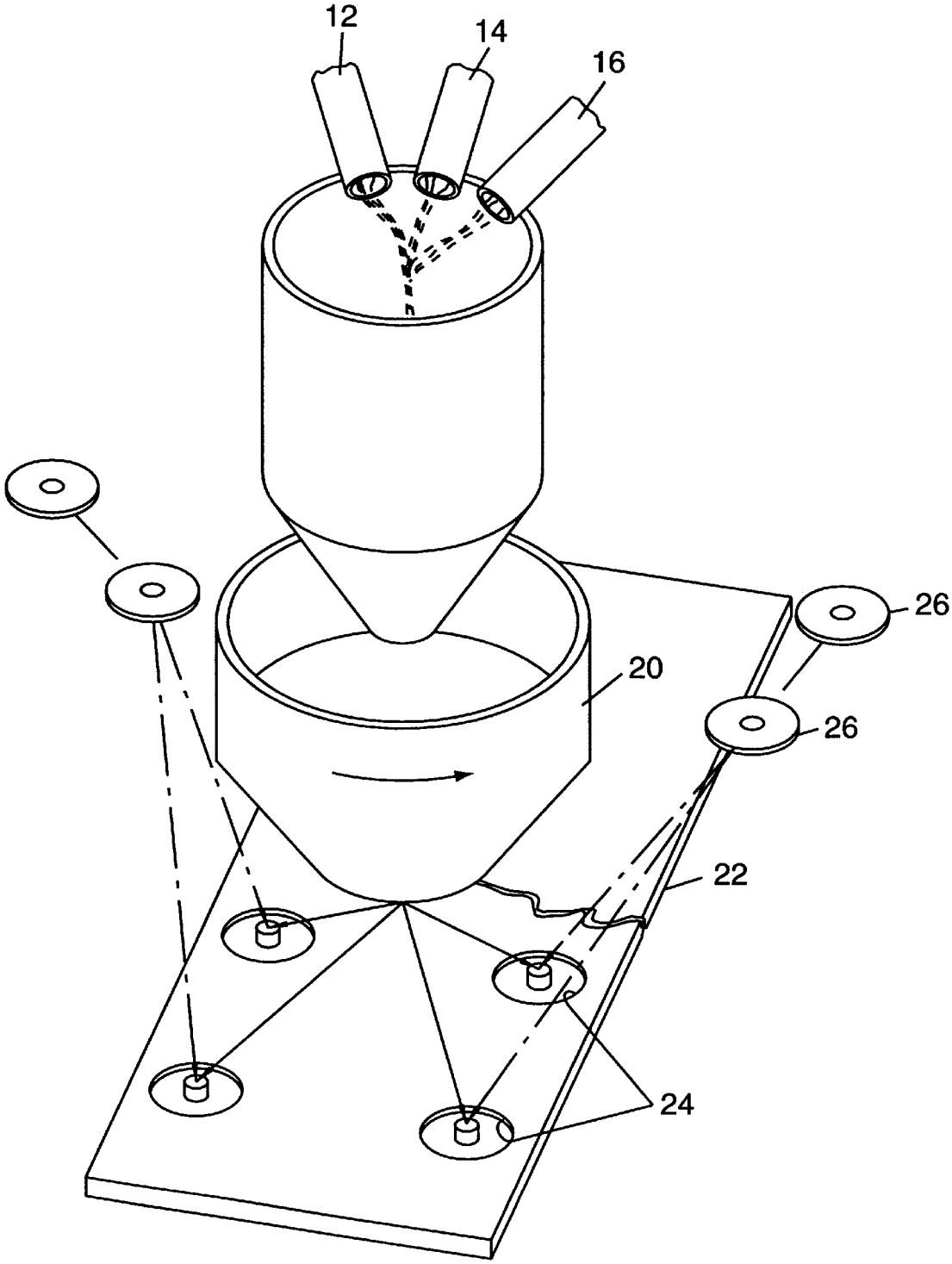
FIG. 1 shows, in schematic fashion, a method for mixing abrasive grains and resin, and providing the mixed material in press cavities in conjunction with reinforcing mats of fiberglass or the like all in accordance with a conventional process for fabricating relatively thin, flat abrasive wheels generally.

Referring now the drawings in greater detail, FIG. 1 shows a standard process for the manufacture of relatively thin, flat "green" wheels which would normally be provided in a fixture to maintain this shape (that is, flat), and to serve as a handling device for moving a plurality of such thin flat wheels into a furnace for curing.

Figure 3:
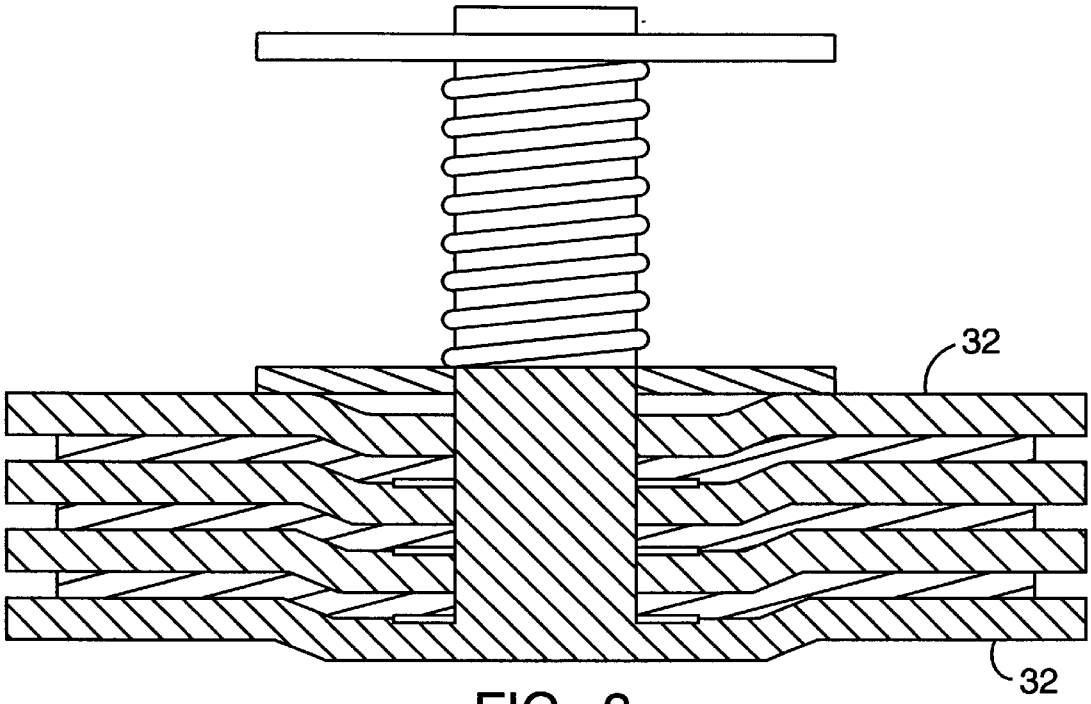
FIG. 3 is a vertical section through a fixture provided for clamping the plates for forming the depressed center portions of the initially flat "green" wheels into thin wheels with depressed center portions.

The present invention contemplates following this standard process for the manufacturing of thin, flat "green" wheels, followed by the unconventional process of providing these wheels between peculiarly shaped plates which are provided in a fixture where they are clamped and thereby formed into a desired shape while still "green". FIG. 3 shows the fixture for so forming such "green" wheels. The fixture is also used to maintain this shape when the wheels are cured in a furnace.

As shown in FIG. 1 and in accordance with conventional practice, a hopper 10 is provided with carefully metered quantities of abrasive grains through a delivery device such as illustrated schematically at 12, and a precisely metered quantity of liquid resin as indicated generally at 14 in FIG. 1.

Other grinding aids may be introduced by the conduit indicated generally at 16 in FIG. 1, and the resulting mixture is provided in a mixing chamber as indicated generally at 20 in FIG. 1.

In further accordance with conventional practice, a hydraulic press includes mating platens, one of which is shown at 22 in FIG. 1 and the platen defines a plurality of press cavities 24, 24, each cavity 24 having a flat inner surface. An opposite platen (not shown) defines the flat upper surfaces of the press cavities. Each of these cavities 24, is provided with a quantity of the mixture from the mixing chamber 20 and layers of reinforcing mats of fiberglass or equivalent reinforcement are placed in the cavities as suggested generally at 26.

Figure 2:
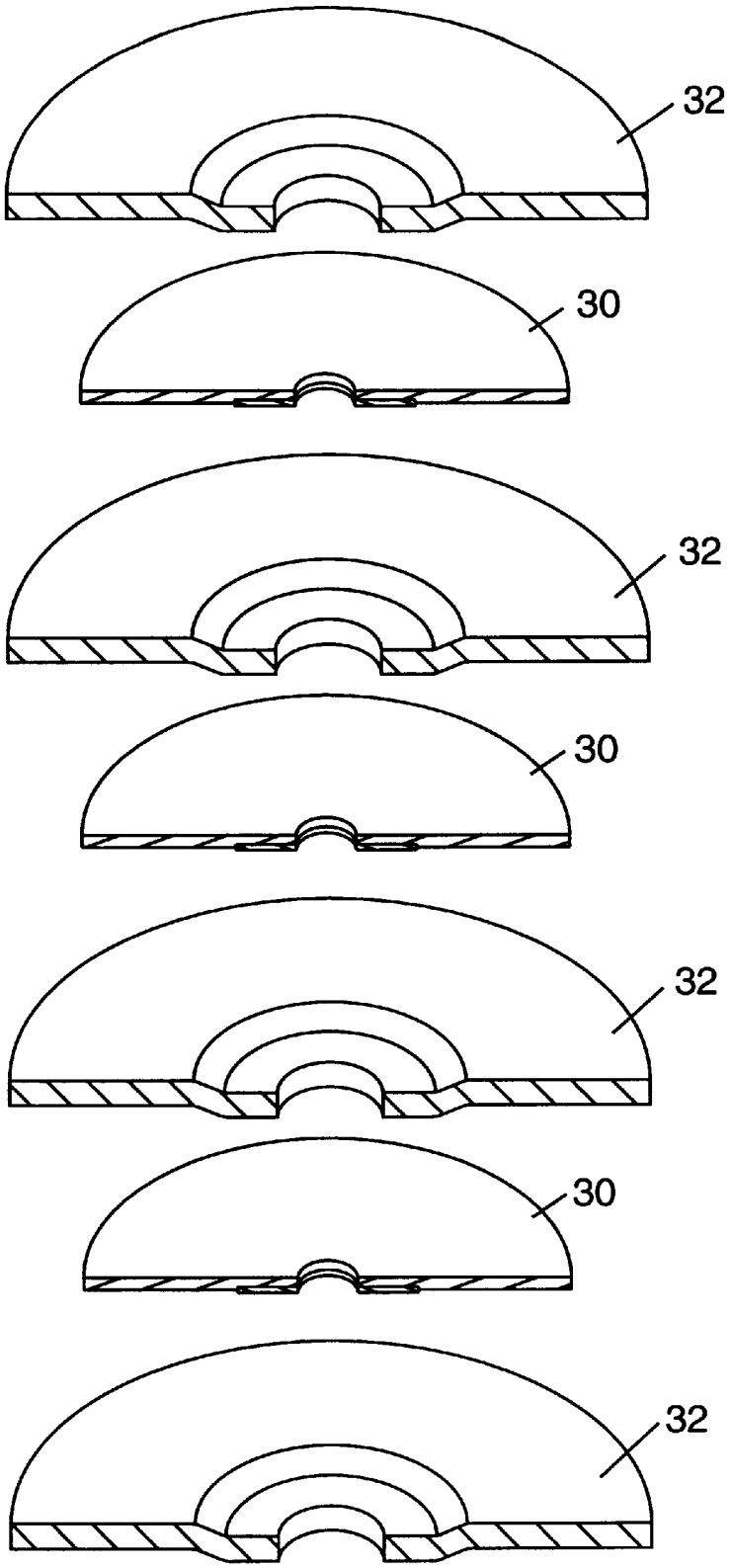
FIG. 2 is an exploded view illustrating in vertical section, the relatively flat and thin "green" wheels formed by the apparatus of FIG. 1 provided between metal plates which define depressed center portions.
Figure 4:
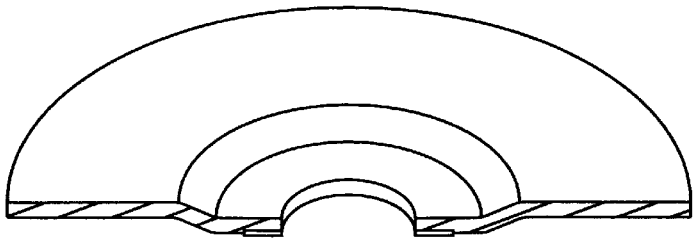
FIG. 4 shows a relatively thin type 27 depressed center wheel formed by the process disclosed.

Following the lay-up of a "green" wheel in its press cavity as described, the upper platen is brought into mating relationship with the platen 22 so that a relatively flat "green" wheel is formed as indicated generally at 30 in FIG. 2. Up to this point, the process described has been used for many years for fabricating generally flat and thin resin type abrasive wheels. However, the prior art does not show or suggest relatively thin resin-type abrasive wheels having a depressed center portion. The reason for this lack of availability of wheels less than 3/32nds of an inch in thickness has been attributed to the inability to maintain uniformity in the lay-up when these wheels are produced by a press which has cavities that include depressed center portions within the platen for the purpose of forming a "green" wheel of this shape and size. In accordance with the present invention, a thin flat "green" wheel is provided in a fixture such as that shown in FIG. 3, where the flat wheel is clamped or formed into a shape having the center portion depressed as illustrated in FIG. 4. As shown in FIGS. 2 and 3, the metal plates 32 are so formed as to have parallel outer portions and depressed center portions with the result that when the plates are clamped as shown in FIG. 3, the "green" flat wheel is formed into a shape such as that shown in FIG. 4.

In further accordance with the present invention, the so formed thin "green" wheels remain in the clamping fixture of FIG. 3 and are transferred in that state to an oven where they are cured in accordance with conventional practice to provide an improved product that gives the user a relatively thin abrasive cutting wheel, that includes a depressed center portion, so that the utility of the wheel is greatly improved to the ultimate user. The heating process provides for increasing the temperature of these "green" molded wheels from ambient to about 185° Celsius. Heretofore, the ultimate user's choice was to purchase either a thicker wheel with a depressed center portion or resort to a relatively thin wheel that did not have a depressed center portion, and hence, might not be adapted for use in his particular apparatus.

What is claimed is:

1. A method for manufacturing depressed center abrasive wheels having a thickness of less than 3/32nds of an inch, said method comprising the steps of:

combining abrasive grains and resin in a mixture, providing a flat wheel press cavity having flat parallel top and bottom press cavity surfaces, providing a lay-up including said mixture and including a reinforcing mat material in said press cavity, compressing said lay-up between said parallel cavity surfaces to provide a flat "green" wheel;

providing said flat "green" wheel between plates that define a depressed wheel center portion, clamping said flat "green" wheel between said plates to form the thin flat "green" wheel into a depressed center portion "green" wheel.

2. The method of claim 1, additionally comprising the step of curing the depressed center "green" wheel in an oven while said depressed "center "green" wheel is clamped in an oven where the resin mixture cures.

3. The method of claim 1, wherein said clamping step is carried out in a fixture adapted to form a plurality of like thin flat "green" wheels into depressed center wheels.

4. The method of claim 3, additionally comprising the step of curing the depressed center "green" wheels while they are in the fixture in an oven where the resin mixture cures, and then removing the depressed center "green" wheels and fixture from the oven.

* * * * *